US012729520B2

(12) United States Patent
Lee

(10) Patent No.: US 12,729,520 B2
(45) Date of Patent: Sep. 8, 2026

(54) QUICK ATTACH CLAMP FOR A FAUCET

(71) Applicant: Delta Faucet Company, Indianapolis, IN (US)

(72) Inventor: David Lee, Westfield, IN (US)

(73) Assignee: Delta Faucet Company, Indianapolis, IN (US)

( * ) Notice: Subject to any disclaimer, the term of this patent is extended or adjusted under 35 U.S.C. 154(b) by 86 days.

(21) Appl. No.: 18/816,326

(22) Filed: Aug. 27, 2024

(65) Prior Publication Data

US 2026/0062898 A1 Mar. 5, 2026

(51) Int. Cl.
*E03C 1/04* (2006.01)

(52) U.S. Cl.
CPC .... *E03C 1/0401* (2013.01); *E03C 2001/0416* (2013.01)

(58) Field of Classification Search
CPC .... F16B 37/08; F16B 37/0814; F16B 37/085; F16B 37/0857; E03C 1/0401
See application file for complete search history.

(56) References Cited

U.S. PATENT DOCUMENTS 852,220 A * 4/1907 Cecil ..... E03C 1/0401 285/193
3,878,757 A * 4/1975 Puklus, Jr. ..... F16B 37/0814 411/433
4,281,857 A * 8/1981 Randall ..... E03C 1/0401 411/433

(Continued)

OTHER PUBLICATIONS

Craftright 80 x 300mm F Clamp—Bunnings Australia; retrieved on Jul. 20, 2026 from https://www.bunnings.com.au/craftright-80-x-300mm-f-clamp_p5860088, 4 pages.

*Primary Examiner* — Erin Deery
(74) *Attorney, Agent, or Firm* — Bose McKinney & Evans LLP

(57) ABSTRACT

A faucet assembly is mounted to a mounting deck that has a passageway extending from a first surface of the mounting deck to a second surface of the mounting deck. The faucet assembly includes a spout that emits a fluid therefrom. A base is installed on the first surface of the mounting deck and between the spout and the mounting deck. The base has a size and shape such that the base cannot pass through the passageway of the mounting deck when installed on the first surface. A mounting shank is connected to the base and is inserted in the passageway. The mounting shank having a circular outer surface having external threads thereon. A nut includes a pipe section having an inner wall with internal threads. The inner wall defines a channel that is sized to receive the mounting shank such that the internal threads of the inner wall mesh with the external threads of the mounting shank. A cantilevered arm extends from an outer wall of the pipe section. The cantilevered arm includes a threaded through-hole. An externally threaded screw is screwed through the threaded through-hole of the cantilevered arm until a distal end of the screw presses against the second surface of the mounting deck and biases the internal threads of the pipe section against the external threads of the mounting shank, thereby securing the faucet assembly to the mounting deck.

20 Claims, 13 Drawing Sheets

(56) References Cited

U.S. PATENT DOCUMENTS

| | | | | |
|---|---|---|---|---|
| 5,906,401 | A * | 5/1999 | Viegener | F16B 37/0842 411/230 |
| 7,753,074 | B2 | 7/2010 | Rosko et al. | |
| 8,695,625 | B2 | 4/2014 | Marty et al. | |
| 12,366,058 | B2 * | 7/2025 | Qiu | E03C 1/0401 |
| 2022/0290417 | A1 | 9/2022 | Currey et al. | |

* cited by examiner

QUICK ATTACH CLAMP FOR A FAUCET

BACKGROUND AND SUMMARY OF THE INVENTION

The present invention relates generally to faucets. Specifically, the present disclosure relates to a structure and related method for quickly mounting a faucet.

Installation of a faucet requires mounting of the faucet to a mounting surface, typically a counter or sink deck adjacent to a basin. Conventional faucet mounting installation methods can be complicated, require substantial time, and/or require multiple components. A cost effective, simpler, and more secure solution for mounting a faucet is desired.

Faucet installation systems typically include a mounting shank that extends through a mounting deck, and a mounting nut that couples to the mounting shank below the mounting deck to secure the faucet thereto. A conventional mounting nut threadably couples with the mounting shank. As a result, the mounting nut may be disposed at various positions along the mounting shank to accommodate mounting decks having a variety of thicknesses. However, it can be tedious and time consuming to rotate the mounting nut from a lower end to an upper end of the mounting shank to couple the faucet to the mounting deck.

The quick attach clamp of the present disclosure simplifies the installation process of a conventional mounting nut. Rather than having to rotate a conventional mounting nut along the length of the externally threaded mounting shank, illustrative securement devices of the present disclosure can be slidably moved upwardly along the length of the mounting shank and then secured once at the desired position. As such, the illustrative securement devices save considerable time in the installation process, particularly when the externally threaded mounting shank is long and the thread pitch is fine.

A faucet assembly and corresponding mounting method are disclosed. The illustrative faucet assembly requires only a single fastening mechanism to secure the faucet assembly to a mounting deck.

The clamp of the present disclosure may reduce the number of components required for assembly of a faucet to a deck, may reduce the cost of the faucet assembly, and reduce the time needed to install the faucet.

The illustrative mounting method works on the premise of friction and binding. When assembling, the nut is angled relative to the faucet mounting shank so that all threads are bypassed and the nut can be moved freely upward around the mounting shank. Once the nut reaches the upper portion of the mounting shank, it can be straightened so that all threads on the inner surface of the nut engage threads on the outer surface of the mounting shank. A jack screw may then be tightened against the bottom surface of the deck to bias the threads together, lock in place, and act as a clamp.

According to an illustrative embodiment of the present disclosure, a faucet assembly is mounted to a mounting deck that has a passageway extending from a first surface of the mounting deck to a second surface of the mounting deck. The faucet assembly includes a spout that emits a fluid therefrom. A base is installed on the first surface of the mounting deck and between the spout and the mounting deck. The base has a size and shape such that the base cannot pass through the passageway of the mounting deck when installed on the first surface. A mounting shank is connected to the base and is inserted in the passageway to carry the fluid through the passageway to the spout. The mounting shank having a circular outer surface having external threads thereon. A nut includes a pipe section having an inner wall with internal threads. The inner wall defines a channel that is sized to receive the mounting shank such that the internal threads of the inner wall selectively mesh with the external threads of the mounting shank. A cantilevered arm extends from an outer wall of the pipe section. The cantilevered arm includes a threaded through-hole. An externally threaded screw is screwed through the threaded through-hole of the cantilevered arm until a distal end of the screw presses against the second surface of the mounting deck and biases the internal threads of the pipe section against the external threads of the mounting shank, thereby securing the faucet assembly to the mounting deck.

According to another illustrative embodiment of the present disclosure, a faucet assembly is mounted to a mounting deck that has a passageway extending from a first surface of the mounting deck to a second surface of the mounting deck. The faucet assembly includes a spout emitting a fluid therefrom. A base is installed on the first surface of the mounting deck and between the spout and the mounting deck. The base has a size and shape such that the base cannot pass through the passageway of the mounting deck when installed on the first surface. A mounting shank is connected to the base and is inserted in the passageway to carry the fluid through the passageway to the spout. The mounting shank has a circular outer surface having external threads thereon. A nut includes a pipe section having an inner wall defining a channel having a first end portion, a middle portion, and a second end portion opposite the first end portion. The channel is sized to receive the mounting shank such that the first end portion is closer than the second end portion to the base. The first end portion includes a first set of partial internal threads that extend less than a full circumference around the channel. The second end portion includes a second set of partial internal threads that extend less than a full circumference around the channel. The second set of partial internal threads has a circumferential position that is offset approximately 180 degrees from a circumferential position of the first set of partial internal threads. A cantilevered arm extends from an outer wall of the pipe section at a location approximately 180 degrees offset around a circumference of the channel from the first set of partial internal threads of the first end portion of the channel. The cantilevered arm includes a threaded through-hole. An externally threaded screw is screwed through the threaded through-hole of the cantilevered arm until a distal end of the screw presses against the second surface of the mounting deck and biases the first set of partial internal threads and the second set of partial internal threads of the pipe section against the external threads of the mounting shank, thereby securing the faucet assembly to the mounting deck.

According to yet another illustrative embodiment of the present disclosure, a locking device is for securing a faucet to a mounting deck that has a passageway extending from a first surface of the mounting deck to a second surface of the mounting deck. A mounting shank of the faucet extends through the passageway of the mounting deck. The mounting shank has a circular outer surface having external threads thereon. The locking device includes a nut having a pipe section with an inner wall defining a channel having a first end portion, a middle portion, and a second end portion opposite the first end portion. The middle portion is skewed relative to the first end portion and the second end portion. The channel is sized to receive the mounting shank such that the first end portion is closer than the second end portion to the mounting deck. The first end portion includes a first set of partial internal threads that extend less than a full circumference around the channel. The second end portion includes a second set of partial internal threads that extend less than a full circumference around the channel. The second set of partial internal threads has a circumferential position that is offset approximately 180 degrees from a circumferential position of the first set of partial internal threads. A cantilevered arm extends from an outer wall of the pipe section. The cantilevered arm has a circumferential position that is offset approximately 180 degrees from a circumferential position of the first set of partial internal threads. The cantilevered arm includes a threaded through-hole. An externally threaded screw is screwed through the threaded through-hole of the cantilevered arm until a distal end of the screw presses against the second surface of the mounting deck and biases the first set of partial internal threads and the second set of partial internal threads of the pipe section against the external threads of the mounting shank, thereby securing the faucet to the mounting deck.

According to a further illustrative embodiment of the present disclosure, a faucet assembly is mounted to a mounting deck having a passageway extending from a first surface of the mounting deck to a second surface of the mounting deck. The faucet assembly includes a spout emitting a fluid therefrom. A base is configured to be installed on the first surface of the mounting deck and between the spout and the mounting deck. The base has a size and a shape such that the base cannot pass through the passageway of the mounting deck when installed on the first surface. A mounting shank is formed of a first material. The mounting shank is connected to the base and is inserted in the passageway to carry the fluid through the passageway to the spout. A nut includes a pipe section is formed of a second material that is harder than the first material. The pipe section has an inner wall with at least one projection. The inner wall defines a channel that is sized to receive the mounting shank. A cantilevered arm extends from an outer wall of the pipe section. The cantilevered arm includes a threaded through-hole. An externally threaded screw is configured to be screwed through the threaded through-hole of the cantilevered arm until a distal end of the screw presses against the second surface of the mounting deck and biases the at least one projection of the pipe section against an outer surface of the mounting shank such that the at least one projection becomes embedded in the mounting shank, thereby securing the faucet assembly to the mounting deck.

According to a still further illustrative embodiment of the present disclosure, a faucet assembly is mounted to a mounting deck having a passageway extending from a first surface of the mounting deck to a second surface of the mounting deck. The faucet assembly includes a spout emitting a fluid therefrom. A base is configured to be installed on the first surface of the mounting deck and between the spout and the mounting deck. The base has a size and a shape such that the base cannot pass through the passageway of the mounting deck when installed on the first surface. A mounting shank is formed of a first material. The mounting shank is connected to the base and is inserted in the passageway to carry the fluid through the passageway to the spout. The mounting shank has an outer surface with at least one projection. A nut includes a pipe section formed of a second material that is softer than the first material. The pipe section has an inner wall defining a channel that is sized to receive the mounting shank. A cantilevered arm extends from an outer wall of the pipe section. The cantilevered arm includes a threaded through-hole. An externally threaded screw is configured to be screwed through the threaded through-hole of the cantilevered arm until a distal end of the screw presses against the second surface of the mounting deck and biases the at least one projection of the mounting shank against the inner wall of the pipe section such that the at least one projection becomes embedded in the pipe section, thereby securing the faucet assembly to the mounting deck.

According to another illustrative embodiment of the present disclosure, a faucet assembly is mounted to a mounting deck having a passageway extending from a first surface of the mounting deck to a second surface of the mounting deck. The faucet assembly includes a spout emitting a fluid therefrom. A base is configured to be installed on the first surface of the mounting deck and between the spout and the mounting deck. The base has a size and a shape such that the base cannot pass through the passageway of the mounting deck when installed on the first surface. A mounting shank is connected to the base and is configured to be inserted in the passageway to carry the fluid through the passageway to the spout. A nut includes a pipe section having an inner wall defining a channel which is sized to receive the mounting shank. A cantilevered arm extends from the pipe section. The cantilevered arm includes a threaded through-hole. An externally threaded screw is screwed through the threaded through-hole of the cantilevered arm until a distal end of the screw presses against the second surface of the mounting deck while the screw is nonparallel to the mounting shank and thereby biases the pipe section against the mounting shank at least two points. Thereby, the faucet assembly is secured to the mounting deck.

According to yet another illustrative embodiment of the present disclosure, a faucet assembly is mounted to a mounting deck having a passageway extending from a first surface of the mounting deck to a second surface of the mounting deck. The faucet assembly includes a spout emitting a fluid therefrom. A base is configured to be installed on the first surface of the mounting deck and between the spout and the mounting deck. The base has a size and shape such that the base cannot pass through the passageway of the mounting deck when installed on the first surface. A mounting shank is connected to the base and is configured to be inserted in the passageway to carry the fluid through the passageway to the spout. A nut includes a pipe section having an inner wall. The inner wall defines a channel that is sized to receive the mounting shank. A cam locking device is rotatably coupled to the pipe section. The cam locking device has an unlocked rotational position and a locked rotational position. The cam locking device presses against the second surface of the mounting deck while the cam locking device is in the locked rotational position to thereby exert a torque on the pipe section and bias the pipe section against the mounting shank at least two points, thereby securing the faucet assembly to the mounting deck.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1:
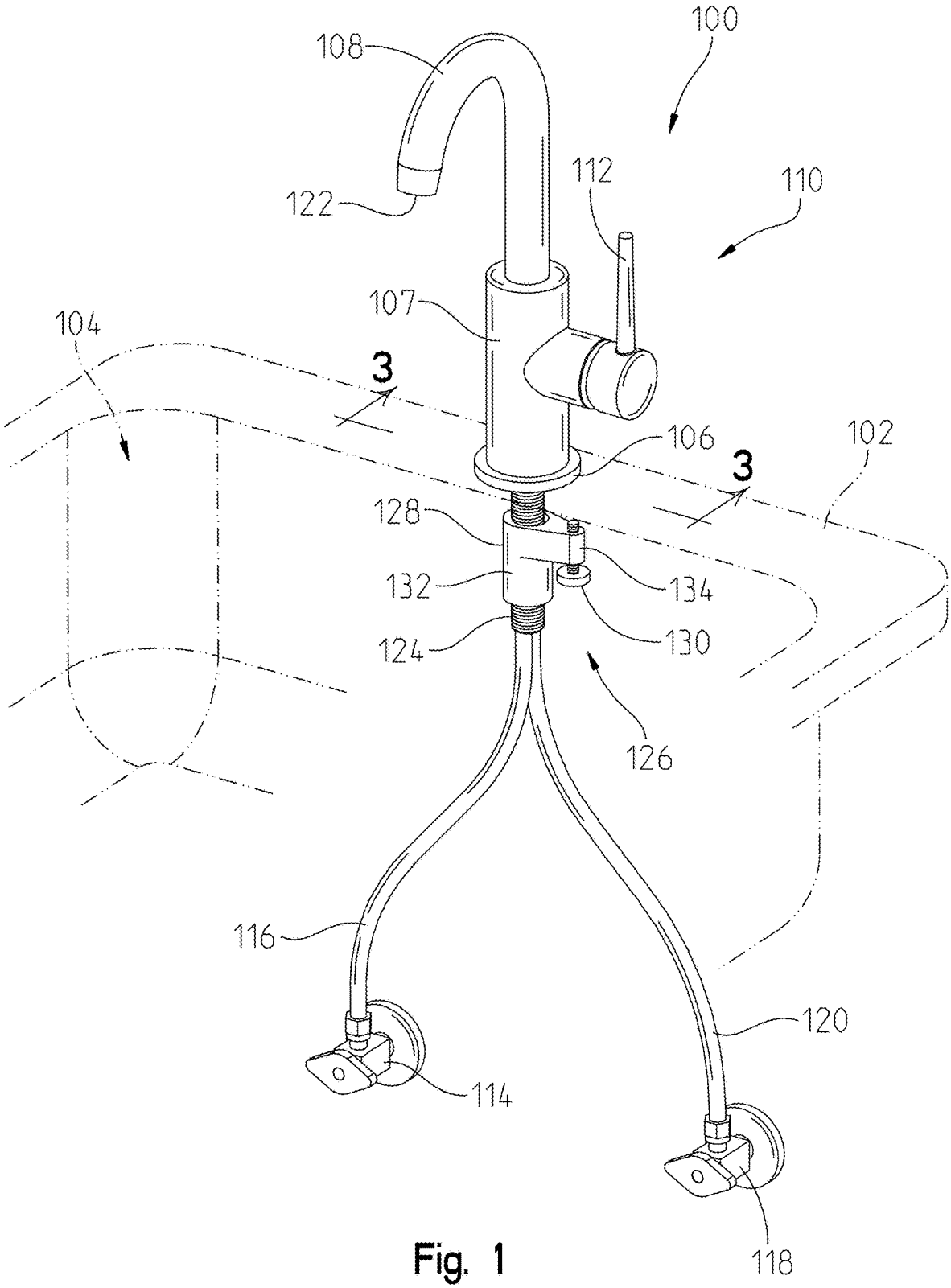
FIG. 1 is a perspective view of an illustrative faucet assembly of the present disclosure mounted to a mounting deck and coupled to a fluid source for operation.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates an embodiment of the invention, and such an exemplification is not to be construed as limiting the scope of the invention in any manner.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Referring initially to FIG. 1, an illustrative faucet assembly 100 of the present disclosure is shown. The faucet assembly 100 is mounted to a mounting deck 102, illustratively a sink deck, adjacent to a basin 104. The illustrative faucet assembly 100 includes an escutcheon 106 positioned below a hub 107. A spout 108 and a valve assembly 110 are operably coupled to the hub 107. Illustratively, the valve assembly 110 includes a handle 112 rotatably supported above the escutcheon 106 so that the handle 112 is configured to rotate relative to the hub 107 and the mounting deck 102 when mounted. In some illustrative embodiments, the spout 108 may also be rotatable relative to the hub 107 and the mounting deck 102.

Referring further to FIG. 1, the valve assembly 110 is fluidly coupled to a first fluid source 114, illustratively a hot water source such as a hot water valve stop. A first source pipe 116 (e.g., a flexible tube formed of a polymer, such as cross-linked polyethylene (PEX)) fluidly couples the first fluid source 114 to the faucet assembly 100 as described further herein. The valve assembly 110 is also operably coupled to a second fluid source 118, illustratively a cold water source such as a cold water valve stop. A second source pipe 120 (e.g., a flexible tube formed of a polymer, such as cross-linked polyethylene (PEX)) fluidly couples the second fluid source 118 to the faucet assembly 100 as described further herein. Illustratively, the faucet assembly 100 is arranged so that actuation of the valve assembly 110 via rotation of the handle 112 about two perpendicular axes permits fluid flow from the first fluid source 114 and from the second fluid source 118 through the spout 108 and through an outlet 122 of the spout 108. The outlet 122 may be defined by a conventional aerator.

Figure 2:
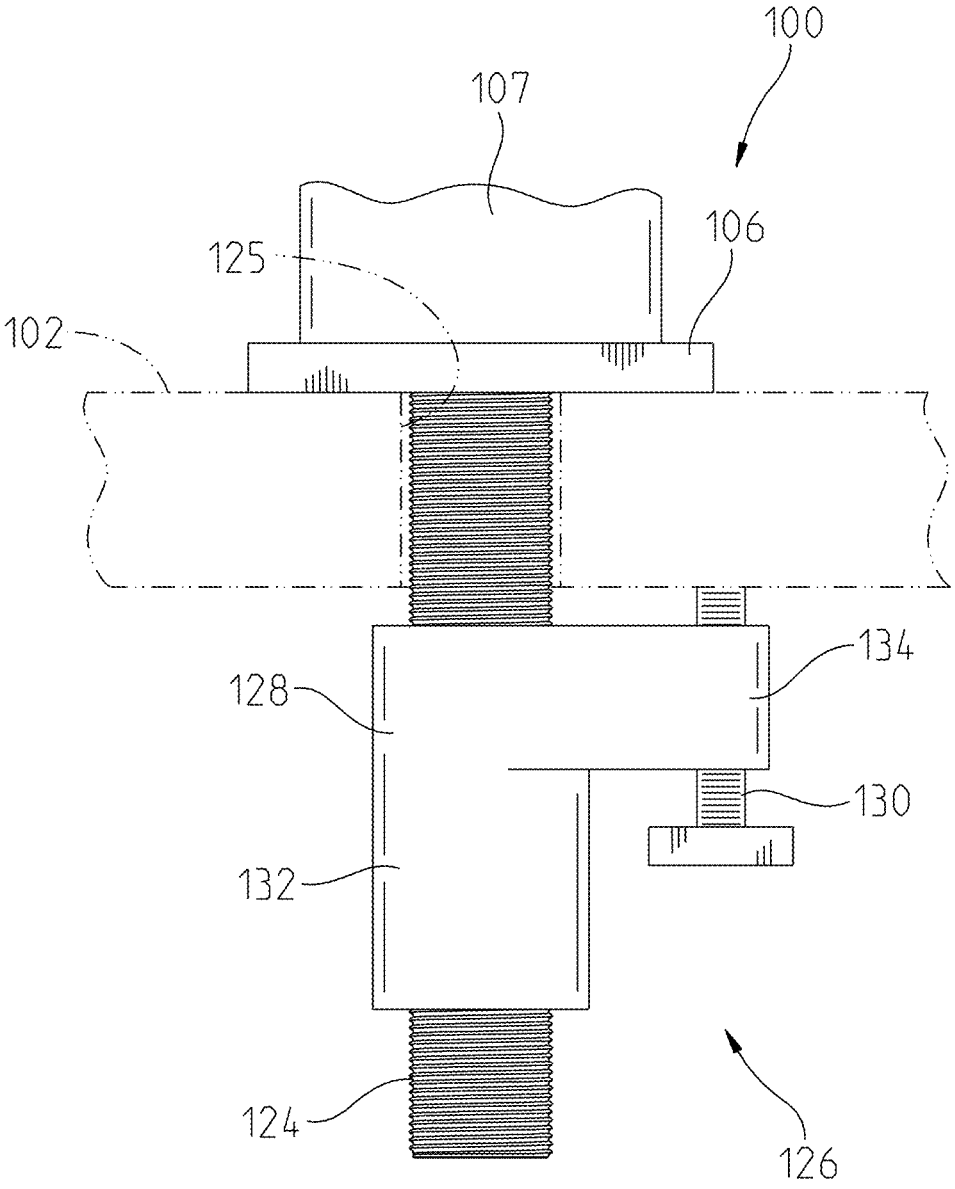
FIG. 2 is an enlarged, fragmentary view of the faucet assembly and mounting deck of FIG. 1.

Referring further to FIG. 1 and to FIG. 2, the faucet assembly 100 includes an externally threaded, cylindrical (circular in cross section) mounting shank 124 that is attached to the hub 107 and/or the spout 108, and that can be inserted through a through-hole 125 or other type of passageway or pass-through in the mounting deck 102. The faucet assembly 100 further includes an illustrative quick attach clamp 126 of the present disclosure. The quick attach clamp 126 is a locking device that secures the faucet assembly 100 to the mounting deck 102, as described in more detail below.

The illustrative quick attach clamp 126 includes a nut 128 and an externally threaded clamping screw 130. As further detailed herein, the nut 128 includes an internally threaded pipe section 132 having a channel that is configured to threadedly receive the mounting shank 124. The nut 128 also includes an internally threaded cantilevered arm 134 that is configured to threadedly receive the clamping screw 130.

Figure 3:
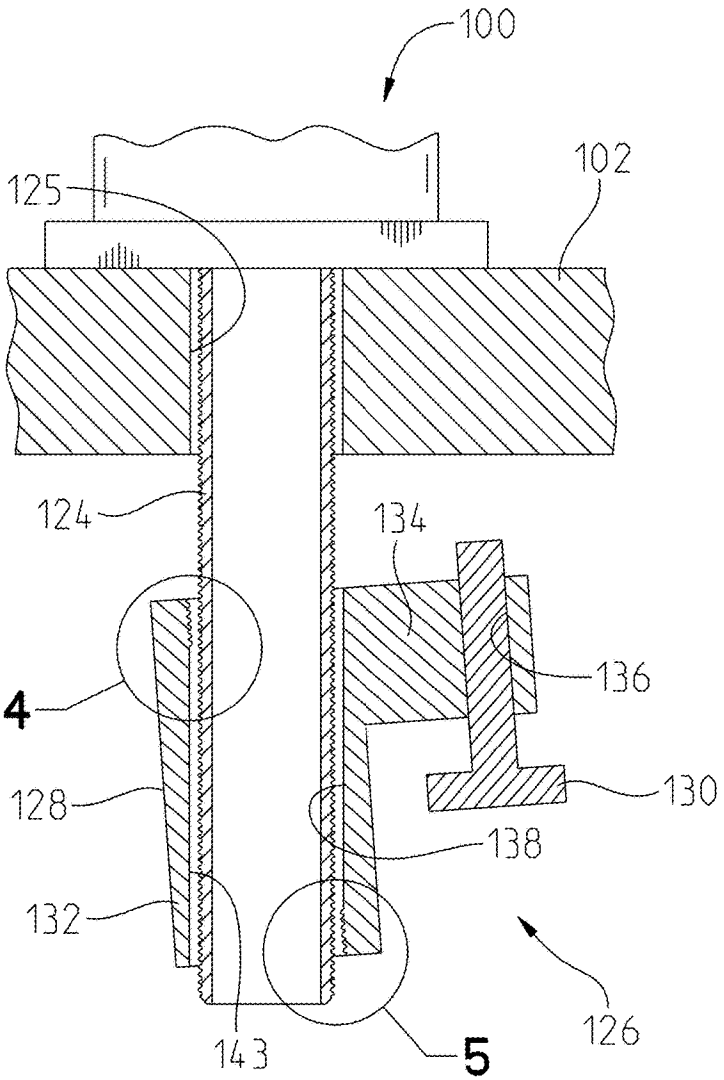
FIG. 3 is an enlarged, fragmentary, cross-sectional view of the faucet assembly and mounting deck of FIG. 1 taken along line 3-3 at a first assembly stage.

FIG. 3 illustrates the faucet assembly 100 and the mounting deck 102 at a first assembly stage wherein the screw 130 has been partially threaded into an internally threaded through-hole 136 in the cantilevered arm 134. The pipe section 132 includes a partially threaded through-hole or channel 138 through which the mounting shank 124 may be inserted.

The through-hole 138 includes a first set of partial internal threads 140 (FIG. 4) that are at a top end portion of the through-hole 138 and that are on a side of the through-hole 138 opposite from the cantilever arm 134. The through-hole 138 also includes a second set of partial internal threads 142 (FIG. 5) that are at a bottom end portion of the through-hole 138 and that are on a side of the through-hole 138 closest to the cantilevered arm 134. Thus, the partial internal threads 142 have a circumferential position that is offset approximately 180 degrees from a circumferential position of the partial internal threads 140. That is, the threads 142 are on a side of the channel 138 that is opposite the threads 140. The internal threads 140, 142 are described above as "partial" in the sense that they may not extend completely around a circumference of the through-hole 138.

Illustratively, a middle longitudinal portion 143 of the channel 138 is unthreaded and may be nonparallel and skewed relative to the threads 140, 142 and relative to the upper and lower end portions of the channel 138. Thus, the mounting shank 124 may pass through the channel 138 without touching the threads 140, 142 or otherwise being impeded by any part of the pipe section 132. The middle longitudinal portion 143 of the channel 138 is also skewed relative to the internally threaded through-hole 136 in the cantilevered arm 134.

Figure 6:
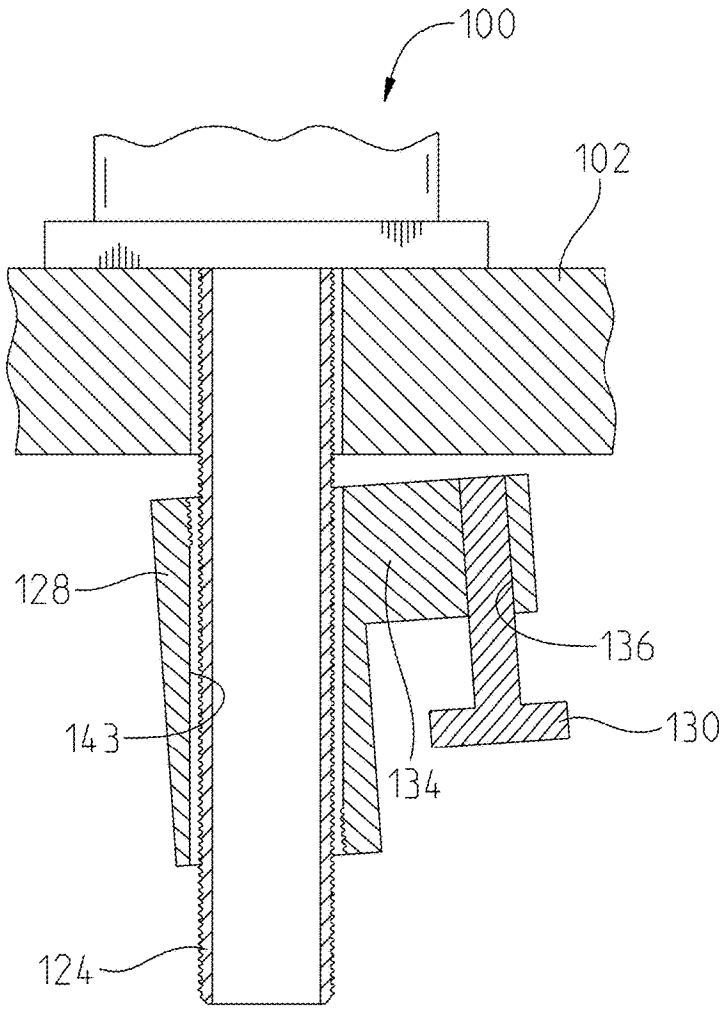
FIG. 6 is an enlarged, fragmentary, cross-sectional view of the faucet assembly and mounting deck of FIG. 1 taken along line 3-3 at a second assembly stage.

FIG. 6 illustrates the faucet assembly 100 and the mounting deck 102 at a second assembly stage wherein the nut 128 has been slid farther up along the mounting shank 124 and closer to the mounting deck 102. The screw 130 has also been partially unscrewed from the through-hole 136 such that an upper end of the screw 130 is flush with the upper surface of the cantilevered arm 134.

Figure 7:
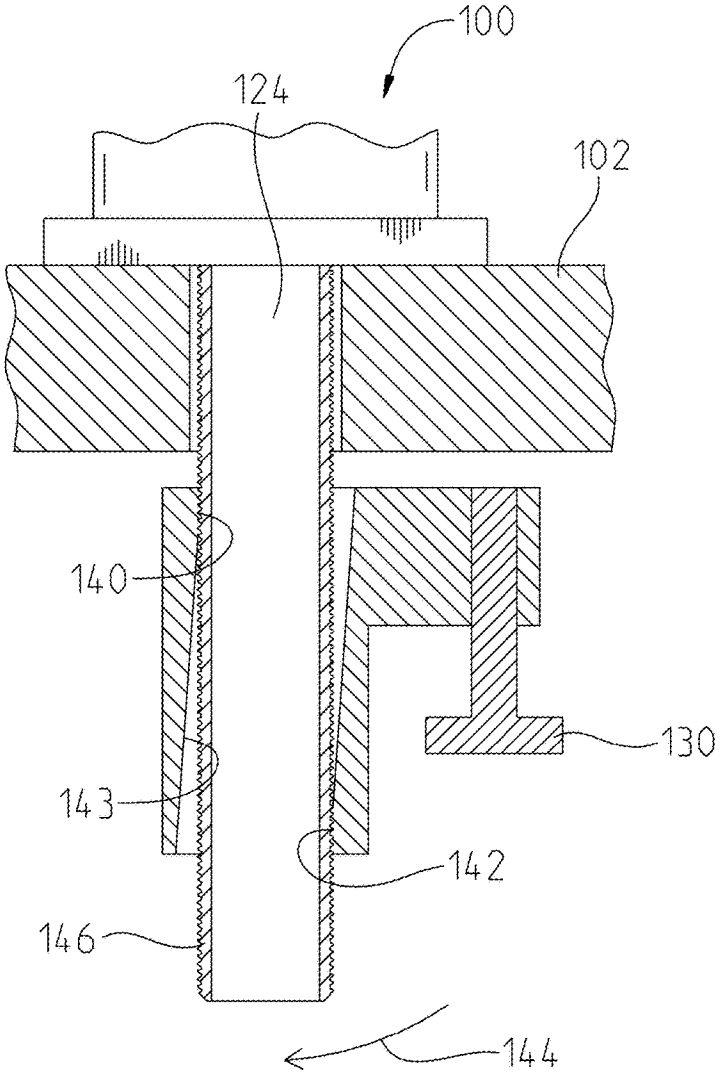
FIG. 7 is an enlarged, fragmentary, cross-sectional view of the faucet assembly and mounting deck of FIG. 1 taken along line 3-3 at a third assembly stage.

FIG. 7 illustrates the faucet assembly 100 and the mounting deck 102 at a third assembly stage wherein the nut 128 and the screw 130 have been rotated in a clockwise direction 144 relative to the viewpoint of FIG. 6 until the internal threads 140, 142 engage the external threads 146 of the mounting shank 124 and no further clockwise rotation is possible.

Figure 8:
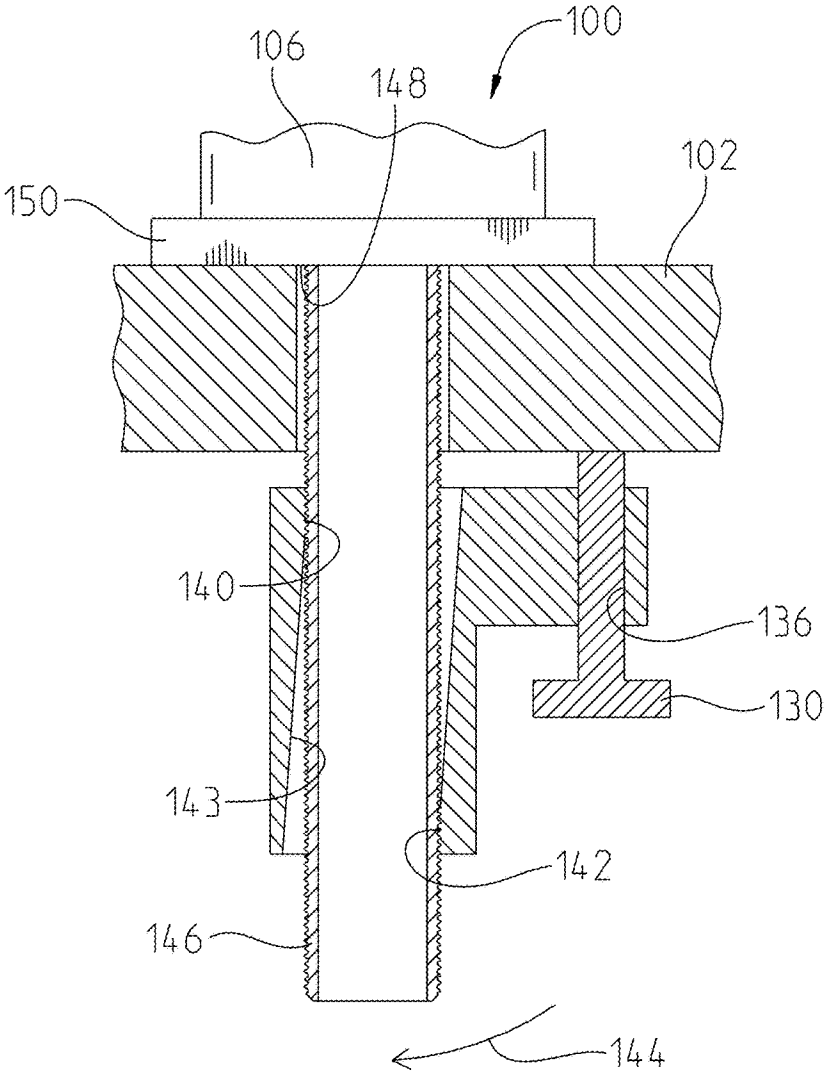
FIG. 8 is an enlarged, fragmentary, cross-sectional view of the faucet assembly and mounting deck of FIG. 1 taken along line 3-3 at a fourth assembly stage.

FIG. 8 illustrates the faucet assembly 100 and the mounting deck 102 at a fourth and final assembly stage wherein the screw 130 has been further screwed into the through-hole 136 until the flat top surface of the screw 130 engages and is pressed against the bottom surface of mounting deck 102. The tightening of the screw 130 by rotatingly advancing the screw 130 through through-hole 136 causes the external threads of the screw 130 to push downwardly against the internal threads of through-hole 136, which biases the nut 128 in clockwise direction 144, biases the internal threads 140, 142 to mesh against the external threads of the mounting shank 124, and biases a bottom surface 148 of a base 150 downwardly against the upper surface of the mounting deck 102. The base 150 is illustratively defined by the escutcheon 106 and/or the hub 107, and has a size and shape that prevents the base 150 from being received in or passing through the through-hole 125 of the mounting deck 102. Thus, the tight interlocking of the internal threads 140, 142 with the external threads of the mounting shank 124 locks the faucet assembly 100 in place relative to the mounting deck 102, and prevents the escutcheon 106 from moving up and away from the mounting deck 102.

The nut 128 may be a single integral piece of cast metal material. However, it is also possible for the cantilevered arm 134 to be formed of sheet metal that is folded at ninety-degree angles to provide the cantilevered arm 134 with enough structural integrity to exert sufficient locking torque on the pipe section 132.

Although the cantilevered arm 134 is shown in the drawings as having a height less than the height of the pipe section 132, it is to be understood that the cantilevered arm 134 is not limited to any particular shape or dimensions. The cantilevered arm 134 need only be rigidly attached to the pipe section 132 and have a through-hole 136 that is far enough away from the pipe section 132 that the screw 130 and the cantilevered arm 134 can exert sufficient torque on the pipe section 132 to bias the threads 140, 142 of the pipe section 132 against the threads 146 of the mounting shank 124 such that the faucet assembly 100 is locked in place relative to the mounting deck 102.

Figure 9:
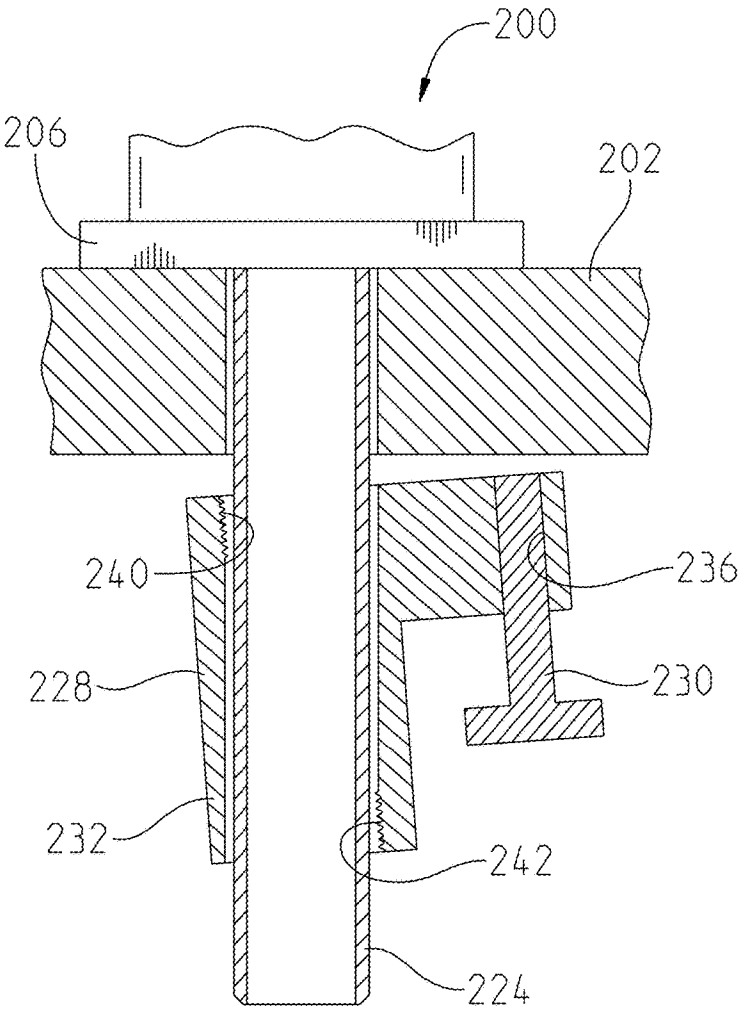
FIG. 9 is an enlarged, fragmentary, cross-sectional view of another illustrative faucet assembly of the present disclosure at one stage of being mounted to a mounting deck.
Figure 11:
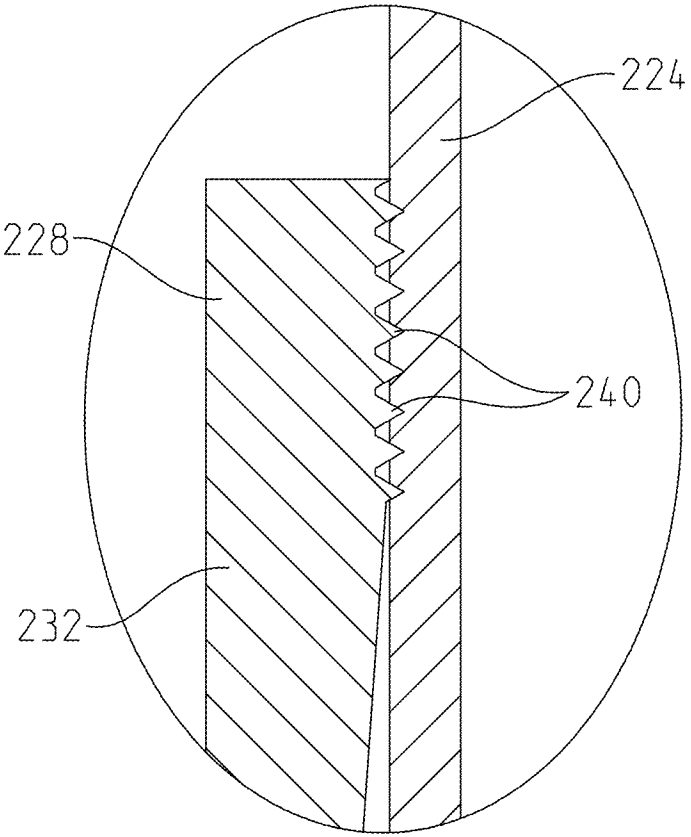
FIG. 11 is an enlarged view of area 11 in FIG. 10.

FIG. 9 illustrates another faucet assembly 200 of the present disclosure at one stage of being mounted to a mounting deck 202. Faucet assembly 200 is substantially similar to faucet assembly 100, except that a mounting shank 224 does not include threads or other irregularities on its cylindrical exterior surface. Rather, the cylindrical exterior surface of mounting shank is smooth and continuous. A further difference is that mounting shank 224 is made of a material that is softer than the material that nut 228 is made of. The material that mounting shank 224 is made of may be soft enough that, when threads 240, 242 of the pipe section 232 are biased against mounting shank 224, the threads 240, 242 may deform the mounting shank 224 and become embedded in mounting shank 224, and such that the faucet assembly 200 is locked in place relative to the mounting deck 202. The embedding of threads 240, 242 in mounting shank 224 (FIG. 11) may effectively create threads in mounting shank 224 that mate very tightly with threads 240, 242.

The pipe section 232 of the nut 228 is shown as having projections in the form of threads 240, 242. However, it is also possible for the pipe section of the nut to have at least one projection in the form of a single tooth or array of teeth instead of threads 240, 242. The tooth or teeth may be spike-shaped or arcuately-shaped, for example.

Figure 10:
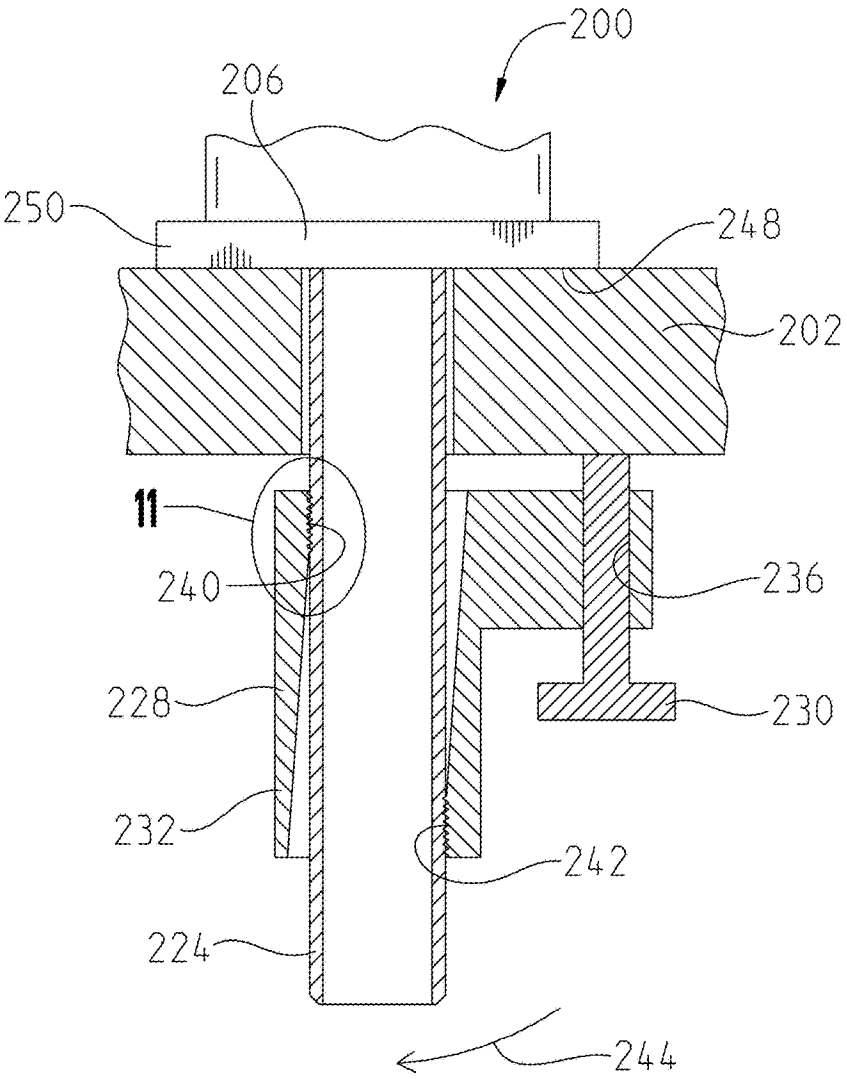
FIG. 10 is an enlarged, fragmentary, cross-sectional view of the faucet assembly of FIG. 9 at a subsequent stage of being mounted to the mounting deck.

FIG. 10 illustrates the faucet assembly 200 and the mounting deck 202 at a later and final assembly stage wherein the screw 230 has been further screwed into the through-hole 236 until the flat top surface of the screw 230 engages and is pressed against the bottom surface of mounting deck 202. The tightening of the screw 230 by rotatingly advancing the screw 230 through through-hole 236 causes the external threads of the screw 230 to push downwardly against the internal threads of through-hole 236, which biases the nut 228 in clockwise direction 244, biases the internal threads 240, 242 to become embedded in the external surface of the mounting shank 224, and biases a bottom surface 248 of a base 250 downwardly against the upper surface of the mounting deck 202. Thus, the tight embedding of the internal threads 240, 242 into the mounting shank 224 locks the faucet assembly 200 in place relative to the mounting deck 202, and prevents the escutcheon 206 from moving up and away from the mounting deck 202.

Figure 12:
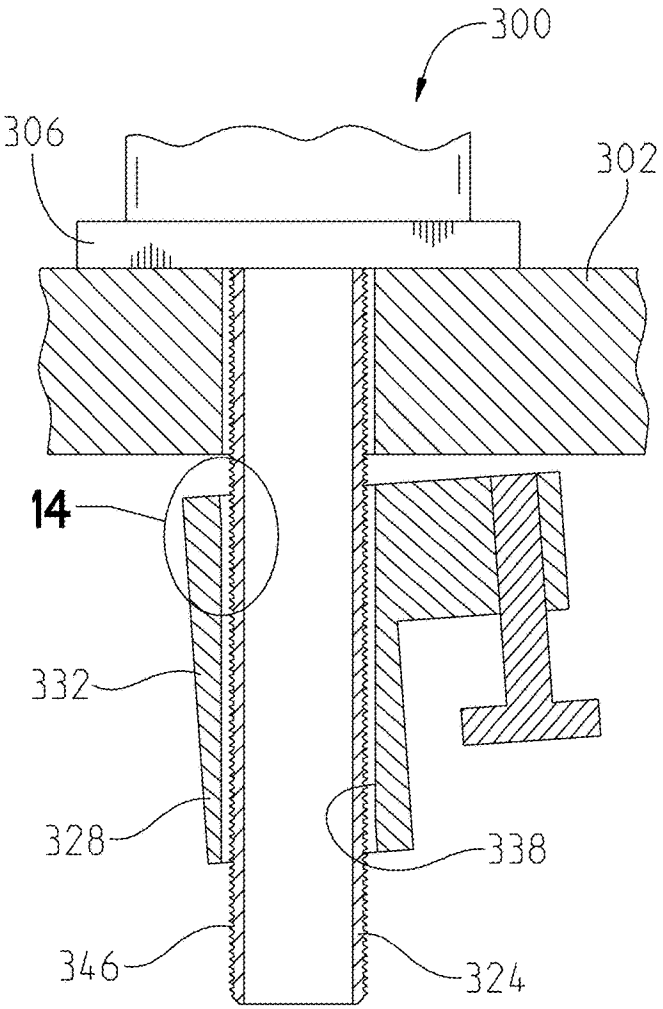
FIG. 12 is an enlarged, fragmentary, cross-sectional view of yet another illustrative faucet assembly of the present disclosure at one stage of being mounted to a mounting deck.

FIG. 12 illustrates yet another faucet assembly 300 of the present disclosure at one stage of being mounted to a mounting deck 302. Faucet assembly 300 is substantially similar to faucet assembly 100, except that a pipe section 332 of a nut 328 does not include threads or other irregularities on its interior surface that defines a channel 338. Rather, the interior surface of pipe section 332 is smooth and continuous. A further difference is that nut 328 is made of a material that is softer than the material that mounting shank 324 is made of. The material that nut 328 is made of may be soft enough that, when pipe section 332 is biased against threads 346 (FIG. 14) of mounting shank 324, the threads 346 may deform the pipe section 332 and become embedded in pipe section 332, and such that the faucet assembly 300 is locked in place relative to the mounting deck 302. The embedding of threads 346 in pipe section 332 (FIG. 15) may effectively create threads in pipe section 332 that mate very tightly with threads 346. It is also possible for the mounting shank to have a single tooth or array of teeth instead of threads 346. The tooth or teeth may be spike-shaped or arcuately-shaped, for example.

Figure 5:
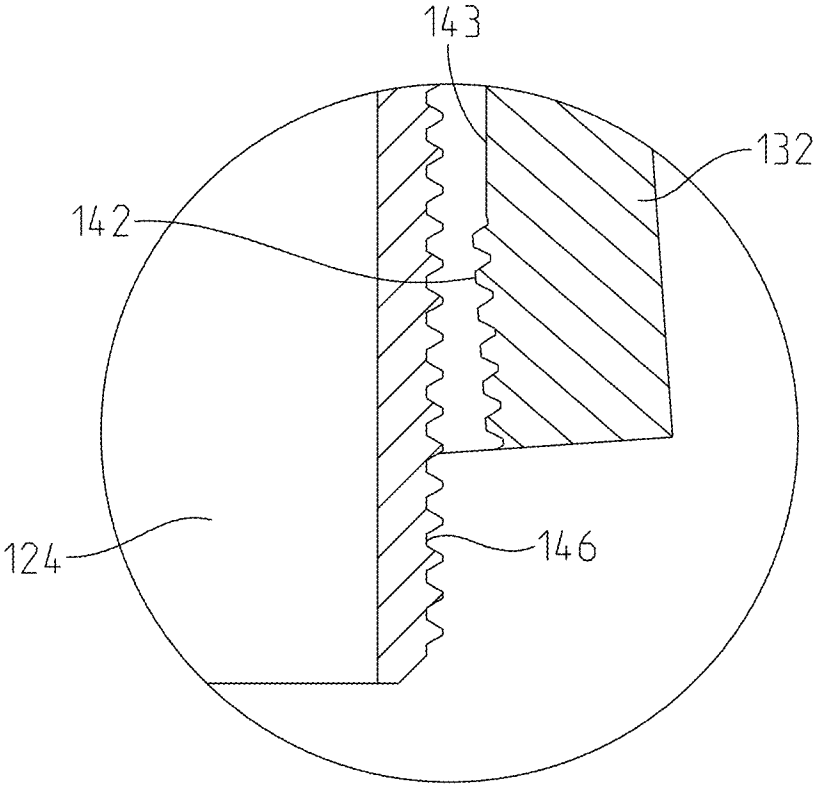
FIG. 5 is an enlarged view of area 5 in FIG. 3.
Figure 4:
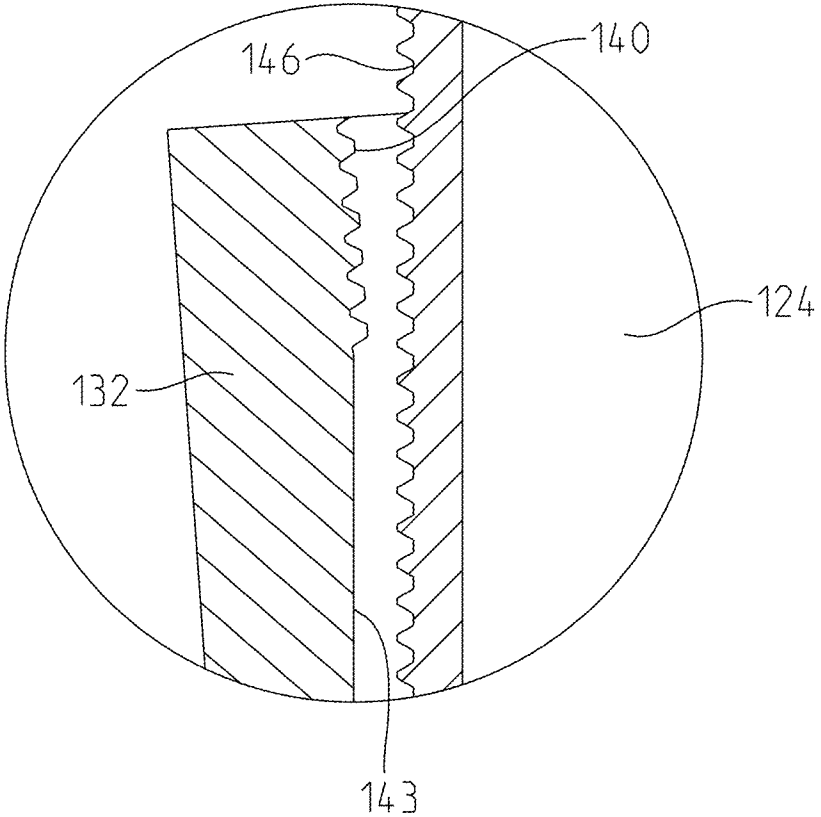
FIG. 4 is an enlarged view of area 4 in FIG. 3.
Figure 15:
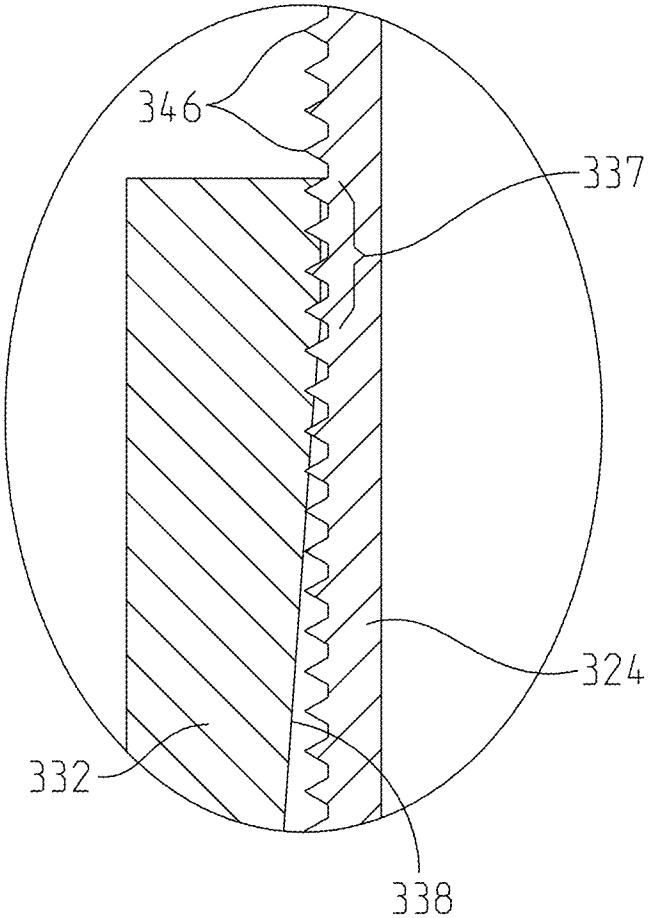
FIG. 15 is an enlarged view of area 15 in FIG. 13.
Figure 14:
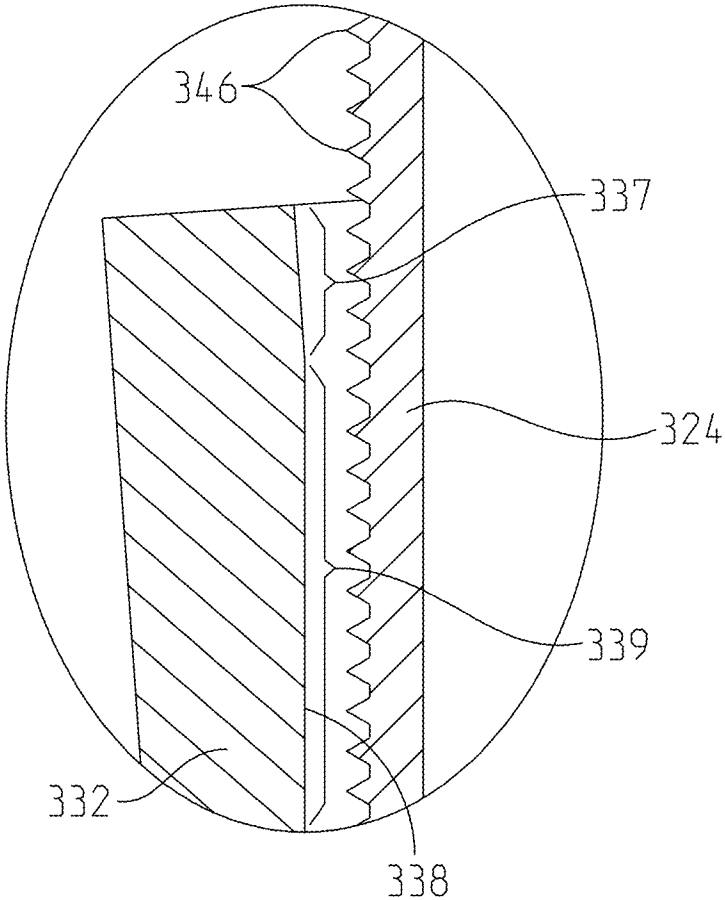
FIG. 14 is an enlarged view of area 14 in FIG. 12.

As shown in FIG. 14, the upper section 337 of channel 338 of pipe section 332 may be unaligned with a middle section 339 of channel 338. Thus, as shown in FIG. 15, the linearly-aligned threads 346 may be positioned more flatly against upper section 337, and may become more evenly and securely embedded in upper section 337 of channel 338. Similarly, a lower section of channel 338 of pipe section 332 may be unaligned with a middle section 339 of channel 338 with the same advantage of becoming more evenly and securely embedded with threads 346. This unalignment or nonlinearity of the pipe section channel may be present in other embodiments of a faucet assembly in this disclosure, such as is shown in FIGS. 4-5.

Figure 13:
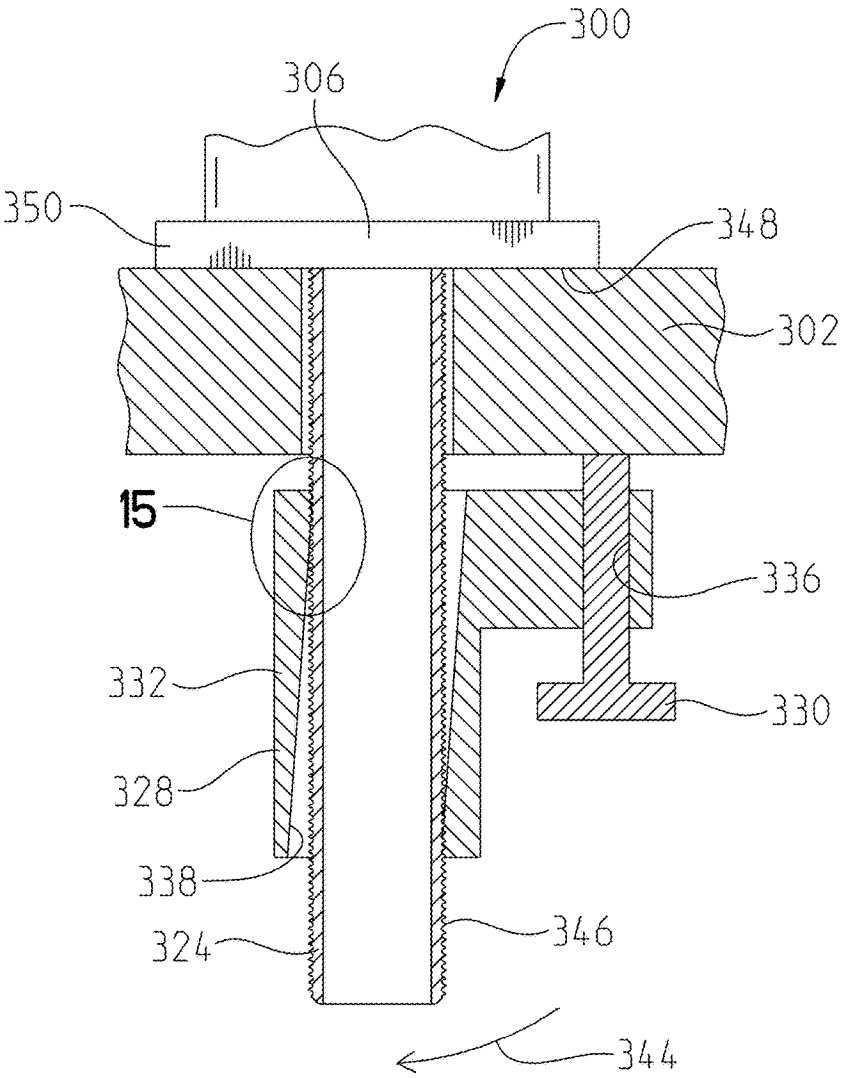
FIG. 13 is an enlarged, fragmentary, cross-sectional view of the faucet assembly and mounting deck of FIG. 12 at a subsequent stage of being mounted to the mounting deck.

FIG. 13 illustrates the faucet assembly 300 and the mounting deck 302 at a later and final assembly stage wherein the screw 330 has been further screwed into the through-hole 336 until the flat top surface of the screw 330 engages and is pressed against the bottom surface of mounting deck 302. The tightening of the screw 330 by rotatingly advancing the screw 330 through through-hole 336 causes the external threads of the screw 330 to push downwardly against the internal threads of through-hole 336, which biases the nut 328 in clockwise direction 344, biases the internal surface of channel 338 against threads 346 such that threads 346 become embedded in the internal surface of channel 338, and biases a bottom surface 348 of a base 350 downwardly against the upper surface of the mounting deck 302. Thus, the tight embedding of the external threads 346 into the pipe section 332 locks the faucet assembly 300 in place relative to the mounting deck 302, and prevents the escutcheon 306 from moving up and away from the mounting deck 302.

Figure 16:
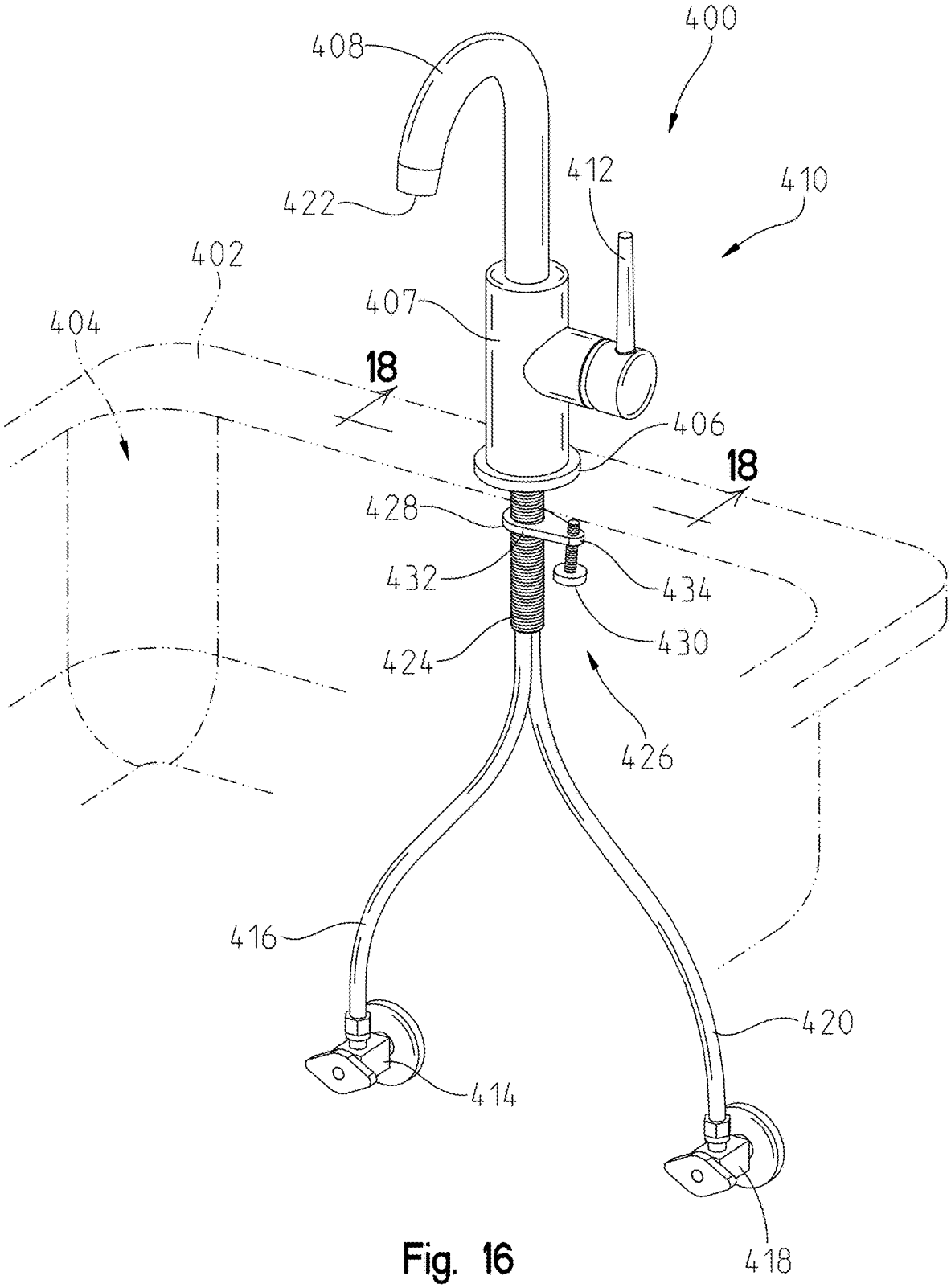
FIG. 16 is a perspective view of yet another illustrative faucet assembly of the present disclosure mounted to a mounting deck and coupled to a fluid source for operation.

FIG. 16 illustrates a further faucet assembly 400 of the present disclosure mounted to a mounting deck 402, illustratively a sink deck, adjacent to a basin 404. The illustrative faucet assembly 400 includes an escutcheon 406 positioned below a hub 407. A spout 408 and a valve assembly 410 are operably coupled to the hub 407. Illustratively, the valve assembly 410 includes a handle 412 rotatably supported above the escutcheon 406 so that the handle 412 is configured to rotate relative to the hub 407 and the mounting deck 402 when mounted. In some illustrative embodiments, the spout 408 may also be rotatable relative to the hub 407 and the mounting deck 402.

Referring further to FIG. 1, the valve assembly 410 is fluidly coupled to a first fluid source 414, illustratively a hot water source such as a hot water valve stop. A first source pipe 416 (e.g., a flexible tube formed of a polymer, such as cross-linked polyethylene (PEX)) fluidly couples the first fluid source 414 to the faucet assembly 400 as described further herein. The valve assembly 410 is also operably coupled to a second fluid source 418, illustratively a cold water source such as a cold water valve stop. A second source pipe 420 (e.g., a flexible tube formed of a polymer, such as cross-linked polyethylene (PEX)) fluidly couples the second fluid source 418 to the faucet assembly 400 as described further herein. Illustratively, the faucet assembly 400 is arranged so that actuation of the valve assembly 410 via rotation of the handle 412 about two perpendicular axes permits fluid flow from the first fluid source 414 and from the second fluid source 418 through the spout 408 and through an outlet 422 of the spout 408. The outlet 422 may be defined by a conventional aerator.

Figure 17:
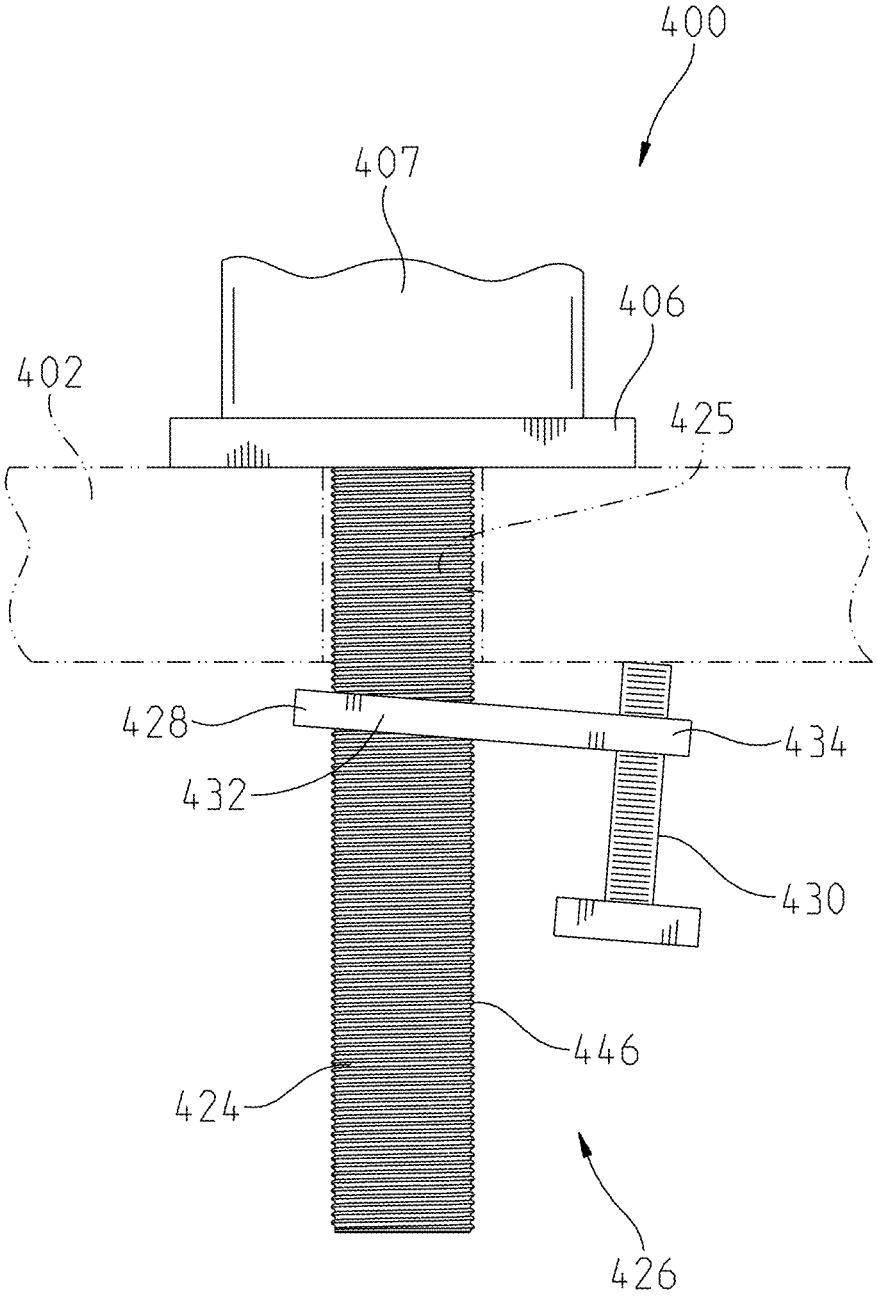
FIG. 17 is an enlarged, fragmentary view of the faucet assembly and mounting deck of FIG. 16.

Referring further to FIG. 16 and to FIG. 17, the faucet assembly 400 includes an externally threaded, cylindrical (circular in cross section) mounting shank 424 that is attached to the hub 407 and/or the spout 408, and that can be inserted through a through-hole 425 or other type of passageway or pass-through in the mounting deck 402. The faucet assembly 400 further includes an illustrative quick attach clamp 426 of the present disclosure. The quick attach clamp 426 is a locking device that secures the faucet assembly 400 to the mounting deck 402, as described in more detail below.

The illustrative quick attach clamp 426 includes a nut 428 and an externally threaded clamping screw 430. As further detailed herein, the nut 428 includes a pipe section 432 having a channel that is configured to receive the mounting shank 424. The nut 428 also includes an internally threaded cantilevered arm 434 that is configured to threadedly receive the clamping screw 430.

Figure 18:
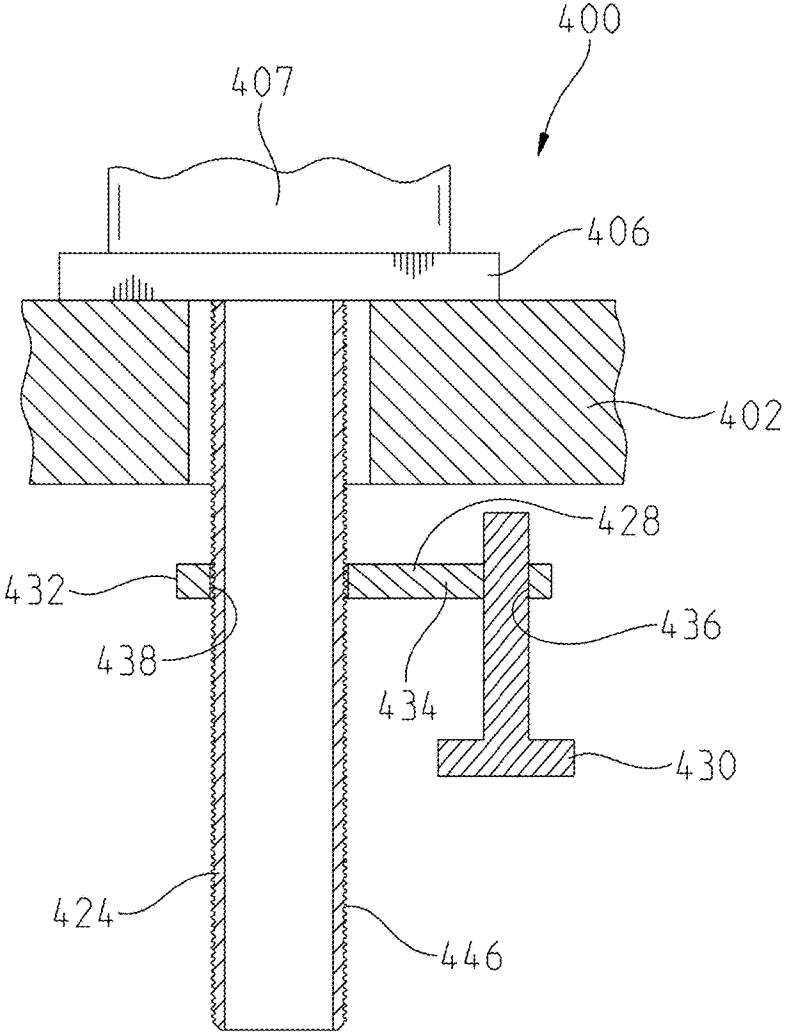
FIG. 18 is an enlarged, fragmentary, cross-sectional view of the faucet assembly and mounting deck of FIG. 16 taken along line 18-18 at one stage of being mounted to a mounting deck.

FIG. 18 illustrates the faucet assembly 400 and the mounting deck 402 at a first assembly stage wherein the screw 430 has been partially threaded into an internally threaded through-hole 436 in the cantilevered arm 434. The pipe section 432 includes a partially threaded through-hole or channel 438 through which the mounting shank 424 may be inserted.

The internal annular wall of pipe section 432 defining through-hole 438 may be smooth and continuous, and may not include any threads, teeth or other discontinuities or irregularities. Although shank 424 is shown as having external threads 446, it is also possible within the scope of the disclosure for the external annular surface the shank to be smooth and continuous, and not include any threads, teeth or other discontinuities or irregularities.

Figure 19:
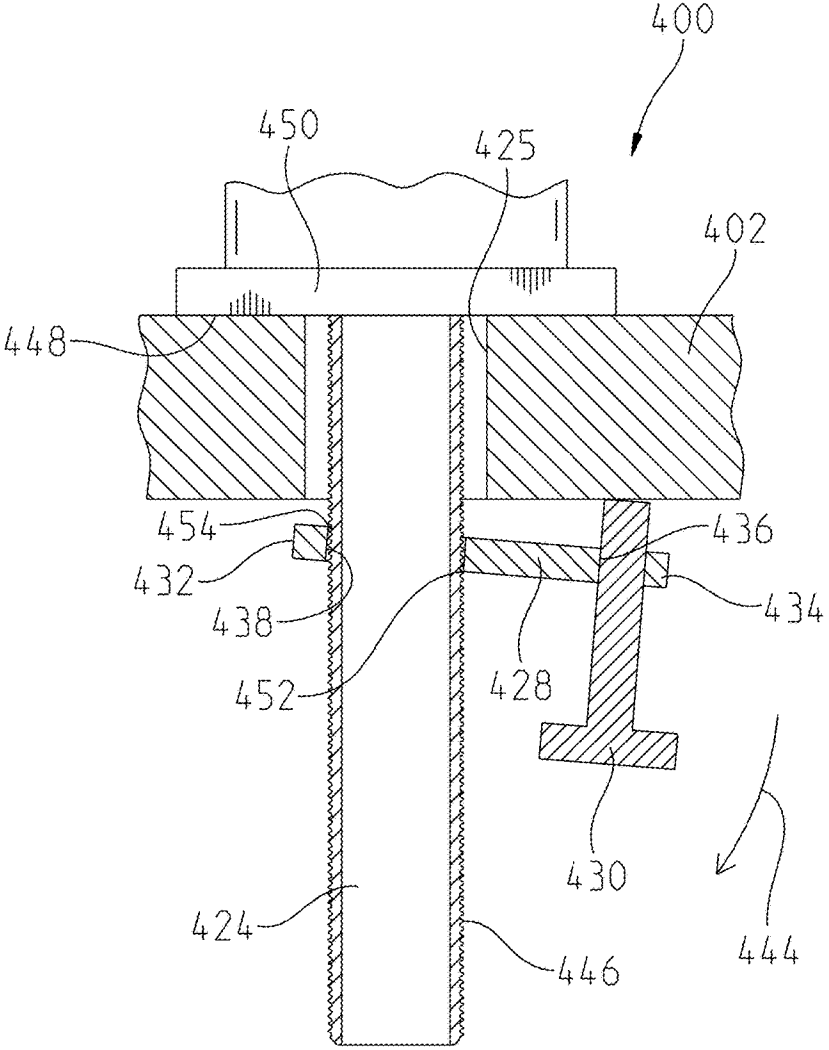
FIG. 19 is an enlarged, fragmentary, cross-sectional view of the faucet assembly and mounting deck of FIG. 16 taken along line 18-18 at a subsequent stage of being mounted to the mounting deck.

FIG. 19 illustrates the faucet assembly 400 and the mounting deck 402 at a second assembly stage wherein the nut 428 has been slid farther up along the mounting shank 424 and closer to the mounting deck 402. The nut 428 and the screw 430 have been rotated in a clockwise direction 444 relative to the viewpoint of FIG. 18 until the nut 428 engages mounting shank 424 at points 452, 454 and no further clockwise rotation is possible. The screw 430 has been further screwed into the through-hole 436 until the flat top surface of the screw 430 engages and is pressed against the bottom surface of mounting deck 402. The tightening of the screw 430 by rotatingly advancing the screw 430 through through-hole 436 causes the external threads of the screw 430 to push downwardly against the internal threads of through-hole 436, which biases the nut 428 in clockwise direction 444 against the mounting shank 124 at points 452, 454, and biases a bottom surface 448 of a base 450 downwardly against the upper surface of the mounting deck 402. The base 450 is illustratively defined by the escutcheon 406 and/or the hub 407, and has a size and shape that prevents the base 450 from being received in or passing through the through-hole 425 of the mounting deck 402. Thus, the tight engagement of the nut 428 with the mounting shank 424 locks the faucet assembly 400 in place relative to the mounting deck 402, and prevents the escutcheon 406 from moving up and away from the mounting deck 402.

As mentioned above, it is not necessary for the mounting shank to have threads or any other irregularities in order to bind with the pipe section of the nut. There is a balance of the clearance between the pipe section and the mounting shank, as well as a ratio of the height of the pipe section to the diameter of the channel of the pipe section that, along with the material hardness, can induce a binding condition. This combination of particular dimensions may simulate the effect of teeth or threads without the need for threads or teeth.

Figure 20:
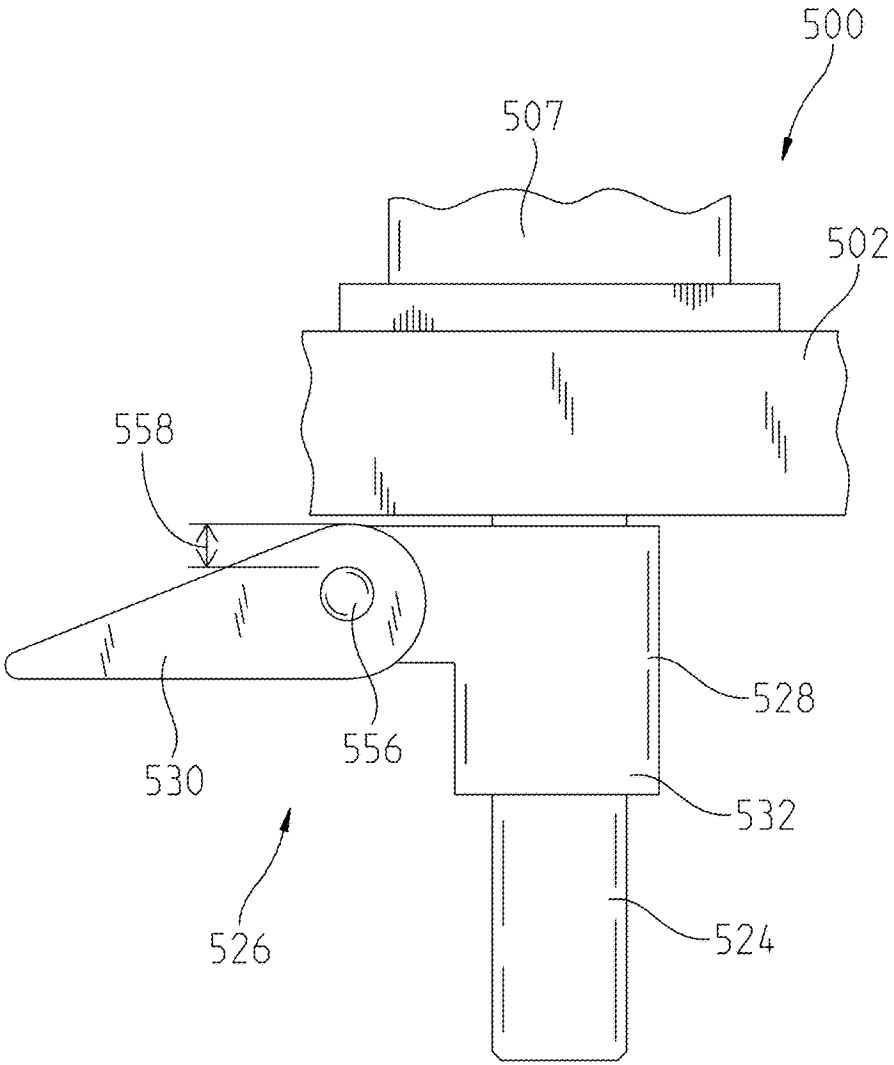
FIG. 20 is a fragmentary, front view of still another illustrative faucet assembly of the present disclosure at one stage of being mounted to a mounting deck.

FIG. 20 is a fragmentary, front view of still another illustrative faucet assembly 500 of the present disclosure at one stage of being mounted to a mounting deck 502. The faucet assembly 500 includes a cylindrical (circular in cross section) mounting shank 524 that is attached to the hub 507 and/or a spout (not shown), and that can be inserted through a through-hole or other type of passageway or pass-through (not shown) in the mounting deck 502. The faucet assembly 500 further includes an illustrative quick attach clamp 526 of the present disclosure. The quick attach clamp 526 is a locking device that secures the faucet assembly 500 to the mounting deck 502, as described in more detail below.

The illustrative quick attach clamp 526 includes a nut 528 rotatably coupled to a teardrop-shaped cam locking device 530. The nut 528 includes a pipe section 532 having a channel (not shown) that is configured to receive the mounting shank 524. An internal annular wall of pipe section 532 defining the channel may be smooth and continuous, and may not include any threads, teeth or other discontinuities or irregularities.

FIG. 20 illustrates the faucet assembly 500 and the mounting deck 502 at a first assembly stage wherein the nut 528 has been slid up along the mounting shank 524 and close to the mounting deck 502, but not touching the mounting deck 502. Cam locking device 530 is in an unlocked horizontal position wherein a thickness 558 of cam locking device 530 between a fixed hub 556 and mounting deck 502 is relatively small.

Figure 21:
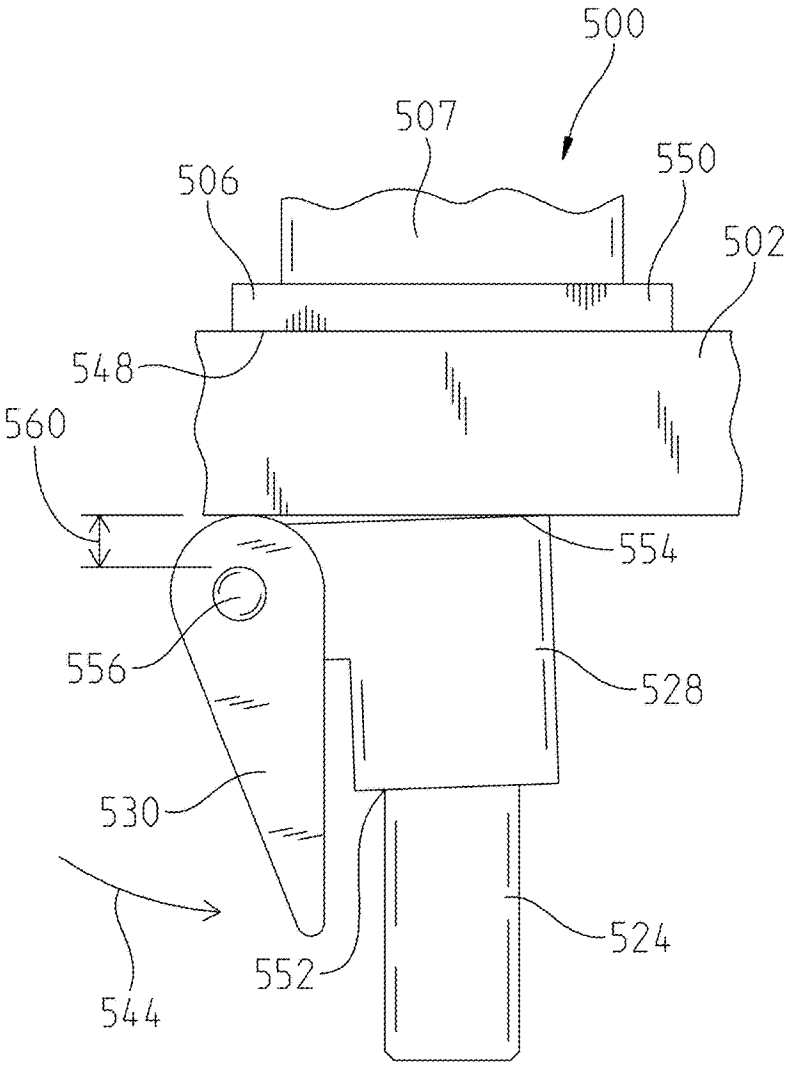
FIG. 21 is fragmentary, front view of the faucet assembly and mounting deck of FIG. 20 at a subsequent stage of being mounted to the mounting deck.

FIG. 21 illustrates the faucet assembly 500 and the mounting deck 502 at a second assembly stage wherein the mounting shank 524 is received in a channel (not shown) the nut 528 has been slid slightly farther up along the mounting shank 524 and into contact with the mounting deck 502. Cam locking device 530 has been rotated about hub 556 in counterclockwise direction 544 to a locked vertical position wherein a thickness 560 of cam locking device 530 between the hub 556 and mounting deck 502 is relatively large, and greater than thickness 558. As cam locking device 530 rotates in counterclockwise direction 544, the thickness of cam locking device 530 between hub 556 and mounting deck 502 gradually increases, which biases the nut 528 in counterclockwise direction 544 against the mounting shank 524 approximately at points 552, 554, and biases a bottom surface 548 of a base 550 downwardly against the upper surface of the mounting deck 502. The base 550 is illustratively defined by the escutcheon 506 and/or the hub 507, and has a size and shape that prevents the base 550 from being received in or passing through a through-hole (not shown) of the mounting deck 502 through which the mounting shank 524 passes. Thus, the tight engagement of the nut 528 with the mounting shank 524 locks the faucet assembly 500 in place relative to the mounting deck 502, and prevents the escutcheon 506 from moving up and away from the mounting deck 502.

The inner wall of the pipe section of the nut and the mounting shank both have been described above as having a circular cross section. However, it is to be understood that one or both of the pipe section and the mounting shank can have different cross-sectional shapes, such as square, rectangular or triangular.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A faucet assembly configured to be mounted to a mounting deck having a passageway extending from a first surface of the mounting deck to a second surface of the mounting deck, the faucet assembly comprising:

a spout configured to emit a fluid therefrom;

a base configured to be installed on the first surface of the mounting deck and between the spout and the mounting deck, the base having a size and shape such that the base cannot pass through the passageway of the mounting deck when installed on the first surface;

a mounting shank connected to the base and configured to be inserted in the passageway to carry the fluid through the passageway to the spout, the mounting shank having a circular outer surface having external threads thereon;

a nut including:

a pipe section having an inner wall with internal threads, the inner wall defining a channel that is sized to receive the mounting shank such that the internal threads of the inner wall selectively mesh with the external threads of the mounting shank; and a cantilevered arm extending from an outer wall of the pipe section, the cantilevered arm including a threaded through-hole; and an externally threaded screw configured to be screwed through the threaded through-hole of the cantilevered arm until a distal end of the screw presses against the second surface of the mounting deck and biases the internal threads of the pipe section against the external threads of the mounting shank, thereby securing the faucet assembly to the mounting deck.

2. The faucet assembly of claim 1 wherein the mounting shank is freely slidable in the channel of the pipe section before the internal threads of the pipe section are biased against the external threads of the mounting shank.

3. The faucet assembly of claim 1 wherein the internal threads of the pipe section do not extend around an entire circumference of the inner wall of the pipe section.

4. The faucet assembly of claim 1 wherein the internal threads of the pipe section include first internal threads at a first end portion of the pipe section and second internal threads at a second end portion of the pipe section.

5. The faucet assembly of claim 4 wherein the pipe section includes an unthreaded middle portion between the first end portion and the second end portion.

6. The faucet assembly of claim 5 wherein the middle portion of the pipe section is skewed relative to the threaded through-hole of the cantilevered arm.

7. The faucet assembly of claim 4 wherein the first internal threads of the pipe section and the second internal threads of the pipe section do not extend around an entire circumference of the inner wall of the pipe section.

8. The faucet assembly of claim 4 wherein the inner wall of the middle portion of the pipe section is unaligned with the first internal threads and the second internal threads of the pipe section.

9. The faucet assembly of claim 1 wherein the externally threaded screw is configured to be screwed through the threaded through-hole of the cantilevered arm until a distal end of the screw directly engages the second surface of the mounting deck.

10. The faucet assembly of claim 1 wherein the externally threaded screw is configured to be screwed through the threaded through-hole of the cantilevered arm until a distal end of the screw presses against the second surface of the mounting deck and exerts a torque on the nut, thereby biasing the internal threads of the pipe section against the external threads of the mounting shank and securing the faucet assembly to the mounting deck.

11. A faucet assembly configured to be mounted to a mounting deck having a passageway extending from a first surface of the mounting deck to a second surface of the mounting deck, the faucet assembly comprising:

a spout configured to emit a fluid therefrom;

a base configured to be installed on the first surface of the mounting deck and between the spout and the mounting deck, the base having a size and shape such that the base cannot pass through the passageway of the mounting deck when installed on the first surface;

a mounting shank connected to the base and configured to be inserted in the passageway to carry the fluid through the passageway to the spout, the mounting shank having a circular outer surface having external threads thereon;

a nut including:

a pipe section having an inner wall defining a channel having a first end portion, a middle portion, and a second end portion opposite the first end portion, the channel being sized to receive the mounting shank such that the first end portion is closer than the second end portion to the base, the first end portion including a first set of partial internal threads that extend less than a full circumference around the channel, the second end portion including a second set of partial internal threads that extend less than a full circumference around the channel, the second set of partial internal threads having a circumferential position that is offset approximately 180 degrees from a circumferential position of the first set of partial internal threads; and a cantilevered arm extending from an outer wall of the pipe section at a location approximately 180 degrees offset around a circumference of the channel from the first set of partial internal threads of the first end portion of the channel, the cantilevered arm including a threaded through-hole; and an externally threaded screw configured to be screwed through the threaded through-hole of the cantilevered arm until a distal end of the screw presses against the second surface of the mounting deck and biases the first set of partial internal threads and the second set of partial internal threads of the pipe section against the external threads of the mounting shank, thereby securing the faucet assembly to the mounting deck.

12. The faucet assembly of claim 11, wherein the middle portion of the channel of the pipe section is skewed relative to the first end portion and the second end portion.

13. The faucet assembly of claim 11 wherein the mounting shank is freely slidable in the channel of the pipe section before the first set of partial internal threads and the second set of partial internal threads of the pipe section are biased against the external threads of the mounting shank.

14. The faucet assembly of claim 11 wherein the middle portion of the pipe section is unthreaded and is skewed relative to the threaded through-hole of the cantilevered arm.

15. The faucet assembly of claim 11 wherein the inner wall of the middle portion of the pipe section is unaligned with the first set of partial internal threads and the second set of partial internal threads of the pipe section.

16. A locking device for securing a faucet to a mounting deck having a passageway extending from a first surface of the mounting deck to a second surface of the mounting deck, a mounting shank of the faucet extending through the passageway of the mounting deck, the mounting shank having a circular outer surface having external threads thereon, the locking device comprising:

a nut including:

a pipe section having an inner wall defining a channel having a first end portion, a middle portion, and a second end portion opposite the first end portion, the middle portion being skewed relative to the first end portion and the second end portion, the channel being sized to receive the mounting shank such that the first end portion is closer than the second end portion to the mounting deck, the first end portion including a first set of partial internal threads that extend less than a full circumference around the channel, the second end portion including a second set of partial internal threads that extend less than a full circumference around the channel, the second set of partial internal threads having a circumferential position that is offset approximately 180 degrees from a circumferential position of the first set of partial internal threads; and a cantilevered arm extending from an outer wall of the pipe section, the cantilevered arm having a circumferential position that is offset approximately 180 degrees from a circumferential position of the first set of partial internal threads, the cantilevered arm including a threaded through-hole; and an externally threaded screw configured to be screwed through the threaded through-hole of the cantilevered arm until a distal end of the screw presses against the second surface of the mounting deck and biases the first set of partial internal threads and the second set of partial internal threads of the pipe section against the external threads of the mounting shank, thereby securing the faucet to the mounting deck.

17. The locking device of claim 16, wherein the mounting shank is freely slidable in the channel of the pipe section before the first set of partial internal threads and the second set of partial internal threads of the pipe section are biased against the external threads of the mounting shank.

18. The locking device of claim 16 wherein the middle portion of the pipe section is unthreaded and is skewed relative to the threaded through-hole of the cantilevered arm.

19. The locking device of claim 16 wherein the inner wall of the middle portion of the pipe section is unaligned with the first set of partial internal threads and the second set of partial internal threads of the pipe section.

20. The locking device of claim 16 wherein the externally threaded screw is configured to be screwed through the threaded through-hole of the cantilevered arm until a distal end of the screw presses against the second surface of the mounting deck and exerts a torque on the nut, thereby biasing the first set of partial internal threads and the second set of partial internal threads of the pipe section against the external threads of the mounting shank and securing the faucet to the mounting deck.

* * * * *